United States Patent [19]

Caswell, Sr.

[11] 4,137,873

[45] Feb. 6, 1979

[54] VARIABLE COMPRESSION RATIO PISTON

[76] Inventor: Dwight A. Caswell, Sr., 15095 Fruitvale Ave., Saratoga, Calif. 95070

[21] Appl. No.: 841,127

[22] Filed: Oct. 11, 1977

[51] Int. Cl.[2] ..... F02B 75/04

[52] U.S. Cl. ..... 123/78 B; 123/193 P; 92/90

[58] Field of Search ..... 123/78 B, 78 BA, 78 AA, 123/193 P, 193 CP; 92/89, 90

[56] References Cited

U.S. PATENT DOCUMENTS

| | | | |
|---|---|---|---|
| 1,305,567 | 6/1919 | Ritter | 123/193 P |
| 1,557,987 | 10/1925 | Coryell | 123/78 B |
| 1,605,838 | 11/1926 | Hawley | 123/78 B |
| 1,719,215 | 7/1929 | Faroy et al. | 123/193 P |
| 2,215,986 | 9/1940 | Stevens | 123/78 AA |
| 2,260,982 | 10/1941 | Walker | 123/78 AA |
| 2,323,742 | 7/1943 | Webster | 123/78 AA |
| 2,376,214 | 5/1945 | Webster | 123/193 P |
| 2,424,868 | 7/1947 | Wantz | 123/78 B |
| 2,467,568 | 4/1949 | Rosaen | 123/78 AA |
| 2,666,421 | 1/1954 | Ring | 123/78 AA |
| 2,769,433 | 11/1956 | Humphreys | 123/78 AA |
| 3,161,185 | 12/1964 | Justinien et al. | 123/78 B |
| 3,187,643 | 6/1965 | Pope | 123/193 P X |
| 3,311,096 | 3/1967 | Bachle et al. | 123/78 B |
| 3,741,175 | 6/1973 | Rouger | 123/78 A |

FOREIGN PATENT DOCUMENTS

| | | | |
|---|---|---|---|
| 2,321,420 | 11/1973 | Fed. Rep. of Germany | 123/193 P |

*Primary Examiner*—Ira S. Lazarus

*Attorney, Agent, or Firm*—Flehr, Hohbach, Test, Albritton & Herbert

[57] ABSTRACT

A piston for use in an internal combustion engine providing a variable compression ratio in response to pressure within the combustion chamber. The pistion includes a base portion which is connected to a crank and moves in an engine cylinder. Joined to the base is a head portion which includes a flexible top wall adjacent the combustion chamber which allows the head to compress downwardly toward the base in response to pressure in the combustion chamber.

11 Claims, 4 Drawing Figures

VARIABLE COMPRESSION RATIO PISTON

BACKGROUND OF THE INVENTION

The invention relates to pistons used in internal combustion engines and more particularly to pistons which provide for variable compression ratios in such engines.

Internal combustion engines are known to achieve greater efficiency and performance with a high compression ratio. High compression engines do have a disadvantage, however. When operated at open throttle the high pressure created within the combustion chamber of the cylinder after ignition tends to cause a secondary post-ignition explosion. This condition is commonly known as "knock." In engines having a fixed compression ratio, knock is prevented at open throttle by retarding the spark or using a higher octane fuel, or by various other techniques. The use of higher octane fuel increases fuel costs and the other techniques decrease engine efficiency.

Low compression engines suffer far less from knock at open throttle even when burning lower octane fuel, such as unleaded fuel. When throttled however, low compression engines are less efficient than high compression engines and tend to achieve less complete combustion of fuel thereby emitting more pollutants in the exhaust.

It is therefore disirable to have an engine with a variable compression ratio which is high when the engine is throttled and decreases as the throttle is opened. Such an engine would be able to achieve high efficiency when throttled while preventing knock when heavily loaded without the need for using high octane fuel.

Several prior art systems have sought to achieve a practical variable compression ratio engine. One such system using a variable ratio piston is shown in U.S. Pat. No. 2,323,742. That system employs a 2-piece piston having an intermediate coil spring. The top and bottom of the piston are held together by a central connecter which is attached by a slip fit to the wrist pin holding the crank connecting rod. The top is secured by a threaded bolt. The numerous parts and the various slidable fittings shown in U.S. Pat. No. 2,323,742 are unsuited to present day automobile engines. The piston head is so heavy that the pressure in the combustion chamber will not overcome the inertia generated, thereby cancelling the benefits of the design. Furthermore, the many parts make the piston unreliable in an engine running at thousands of r.p.m. where the parts are subjected to such stresses as to cause failure and separation. The loosening or failure of any part within such a piston would severely damage or destroy the engine. Similar complex pistons are shown in U.S. Pat. No. 2,376,214 and U.S. Pat. No. 3,311,096.

Another method of adjusting the compression ratio of an engine is to provide auxiliary pistons or chambers which alter the size of the combustion chamber. Representative examples of such systems are shown in U.S. Pat. Nos. 2,215,986 and 2,260,982. These systems are highly complex, requiring complete redesign of the engine block, and cannot be retrofitted into present automobile engines.

OBJECTS AND SUMMARY OF THE INVENTION

It is therefore an object of the invention to provide a piston which improves the performance of an internal combustion engine.

It is another object to provide such a piston in which the compression ratio of the engine changes in response to pressure in the combustion chamber.

It is still another object to provide such a piston in which the head portion adjacent the combustion chamber includes a flexible top wall.

Accordingly, a piston is provided which is connectable to a crank for reciprocation in a cylinder of an internal combustion engine. The piston forms one wall of a combustion chamber in the cylinder. The piston includes a base portion with cylindrical side walls. Means are provided on the base portion for connecting the piston to a crank. A head portion is joined only to the side walls of the base portion. The head portion includes a flexible top wall adjacent the combustion chamber of the engine. The flexible top wall is resiliently yieldable in response to pressure within the combustion chamber whereby the head portion flexes downwardly to provide for variation of the compression ratio of the engine.

DESCRIPTION OF THE PREFERRED EMBODIMENT

Figure 1:
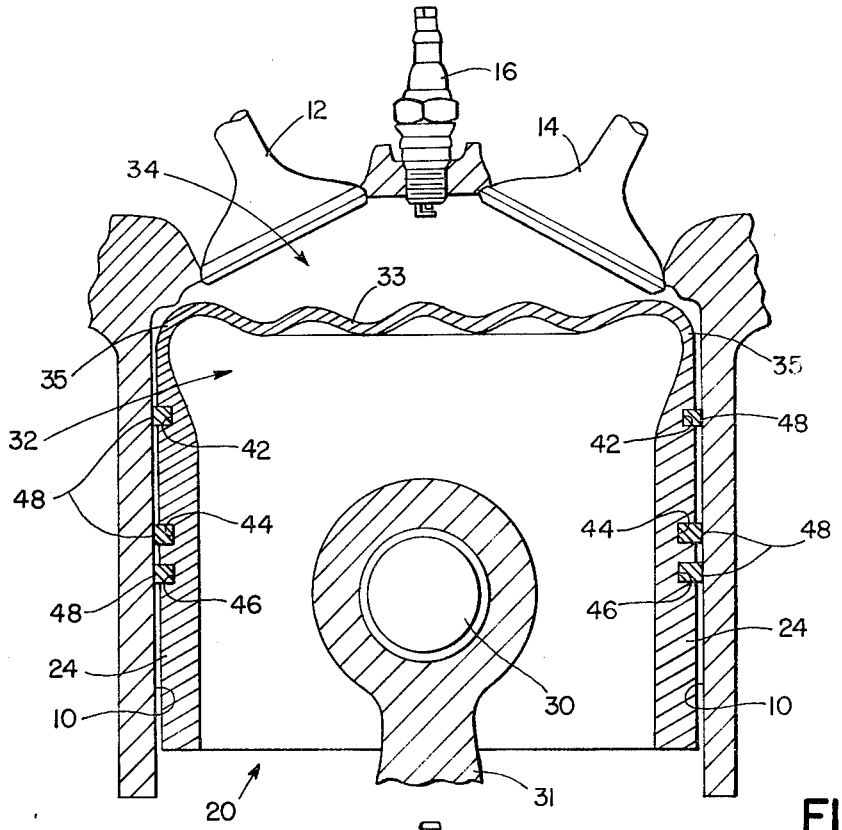
FIG. 1 is a cross sectional view through the cylinder of an internal combustion engine showing a piston according to the present invention.

Referring to FIG. 1, a cylinder of an internal combustion engine having a first embodiment of a piston according to the invention is shown. Cylinder walls 10 extend downwardly opening into the crankcase in the usual manner. Intake and exhaust valves 12 and 14 provide suitable openings for the entrance of fuel and the exit of exhaust, as is well known in the art. Spark plug 16 provides the ignition spark. Slidable within cylinder 10 is a piston 20 formed of metal. The piston includes base portion having cylindrical side walls 24. A wrist pin 30 provides means on the base portion for connection of the piston to arm 31. Arm 31 is rotatably attached to pin 30 and joins with a crankshaft in the crankcase in the usual manner.

The piston includes a head portion 32 joined only to the side walls 24 of base 22. No internal fasteners or slidable fittings are used to join the head to the base. Head 32 includes a flexible top wall 33 adjacent combustion chamber 34 of the engine cylinder. Flexible top wall 33 is resiliently yieldable in response to pressure within combustion chamber 34. To increase its yieldability, top wall 33 is corregated. Preferably, a plurality of substantially circular corregations are provided, giving a wavy appearance when viewed in cross section, as in FIG. 1.

Head portion 32 also includes rounded shoulder portions 35 which join top wall 33 to side walls 24. Both the shoulder portions and the top wall of the piston which together form the piston head are formed of thinner metal than side walls 24 of the base. The thinner metal imparts flexibility to the piston head whereas the thicker base walls 24 are rigid. Forming shoulders 35 of the thinner metal provides for increased downward movement of the flexible top wall.

The walls of piston 20 are equipped with circumferential grooves 42, 44 and 46 which provide seats for piston rings 48. Rings 48 space the piston from cylinder 10 and prevent blow-by of gases in the usual manner. The engine crankcase and the portion of cylinder 10 below the piston are filled with lubricating oil.

Figure 2:
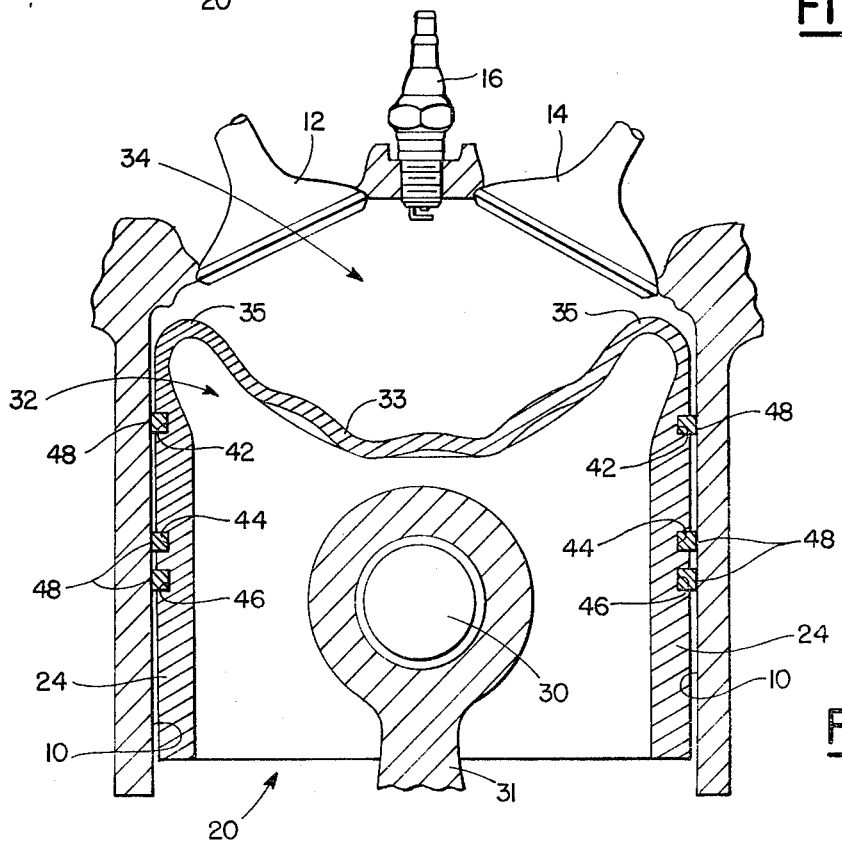
FIG. 2 is a cross sectional view of the piston of FIG. 1 when compressed under the influence of high pressure in the combustion chamber.

Operation of the piston is best illustrated in conjunction with both FIGS. 1 and 2. In a typical 4-cycle engine the piston reciprocates in cylinder 10 passing through the various cycles. When the piston is at the bottom of a stroke it maintains a shape as shown in FIG. 1. During the compression stroke the piston moves upward in the cylinder, compressing the air-fuel mixture therein in preparation for ignition. Under throttled conditions the piston will move to the top with little or no distortion, as shown in FIG. 1. Usually somewhat prior to reaching top-dead-center the fuel will be ignited by spark plug 16. The expansion of gases will drive the piston down the cylinder to provide the power stroke. The piston then passes through the exhaust cycle, expelling the exhaust gases.

During the exhaust cycle the exhaust valve is open and the piston repeats its reciprocation. Because no gases are being compressed the piston retains its shape as shown in FIG. 1 during the exhaust cycle. It therefore produces maximum evacuation of the cylinder. The result is that there is less clearance gas left in the cylinder after exhaust than in a conventional low-compression engine. This reduces dilution of the next fuel charge by the clearance gas. The result is a better fuel-air mixture, especially at idle speeds. Improved clearance gas expulsion also allows for lower idle speeds, permitting full savings.

Referring to FIG. 2, piston 20 is shown under open throttle conditions. During the compression stroke the gases in the cylindcr are compressed and ignited. The larger fuel charge causes far higher pressures within the combustion chamber. In a high-compression fixed-ratio engine the high pressure would cause a second explosion, or "knock" if low octane fuel is used. To prevent such knock and the accompanying loss of power and engine wear, piston 20 provides for an increase in the size of combustion chamber 34 when subjected to high pressure. FIG. 2 illustrates the change which takes place. The central part of top wall 33 is forced downwardly and the rounded shoulders 35 also yield, make piston 20 smaller. This limits the pressure during combustion to levels such as those found in low-compression engines, thereby reducing the likelihood of knock even with low octane fuel.

It should be understood that the top wall and shoulders of head portion 32 are designed to yield only under high pressures. Therefore, the thinner metal used to make the head should not impart excessive flexibility. Otherwise, the head will tend to yield even when the engine is throttled, and the high compression operation sought will be compromised.

The flexible top 33 of the piston and the shoulders 35 are subjected to flexing, heat, and chemical attack and must necessarily be formed of a material which will provide long life. Metals which include beryllium copper or titanium are particularly adapted to such a severe environment. It is therefore recommended that head portion 32 of the piston be formed of a metal containing beryllium copper of titanium.

The variations in compression ratio achieved using the piston of the present invention depends on the cylinder configuration, the thickness of the head portion and the material used in the piston. It is intended that the piston provide a compression ratio of approximately 15:1 to 20:1 when undistorted. Under open throttle conditions and maximum distortion, the compression ratio drops to approximately 8:1. The lower compression ratio therefore substantially conforms to that of the majority of cars manufactured since 1975. Such cars are particularly designed to run on lower octane unleaded fuel.

Figure 3:
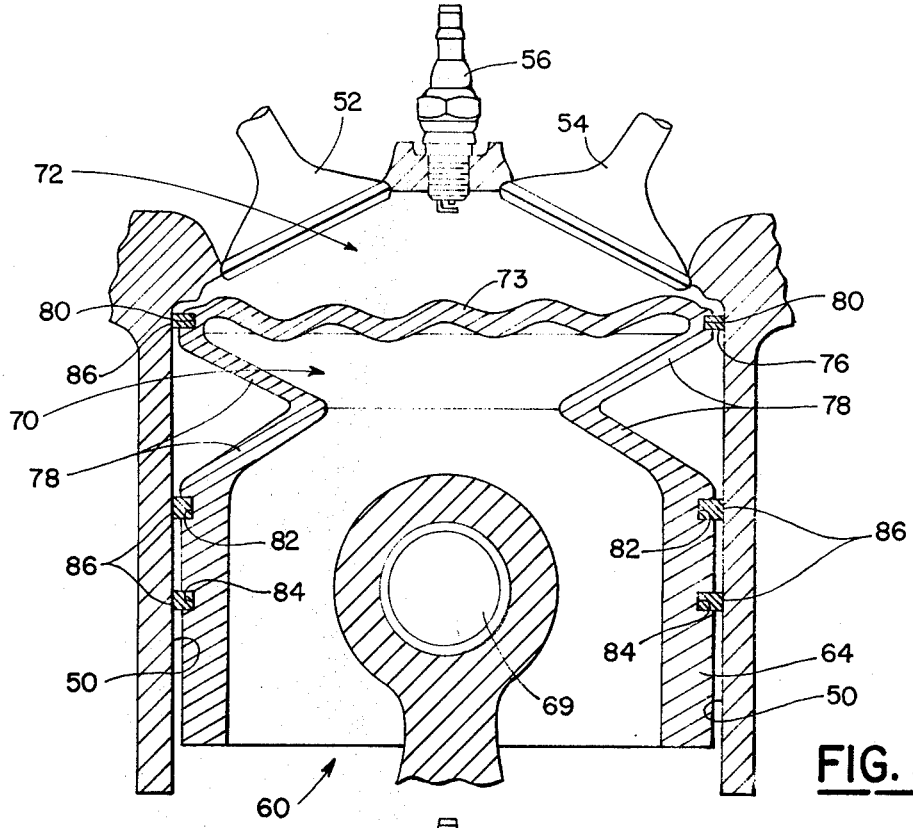
FIG. 3 is a view as in FIG. 1 of another embodiment of the invention.
Figure 4:
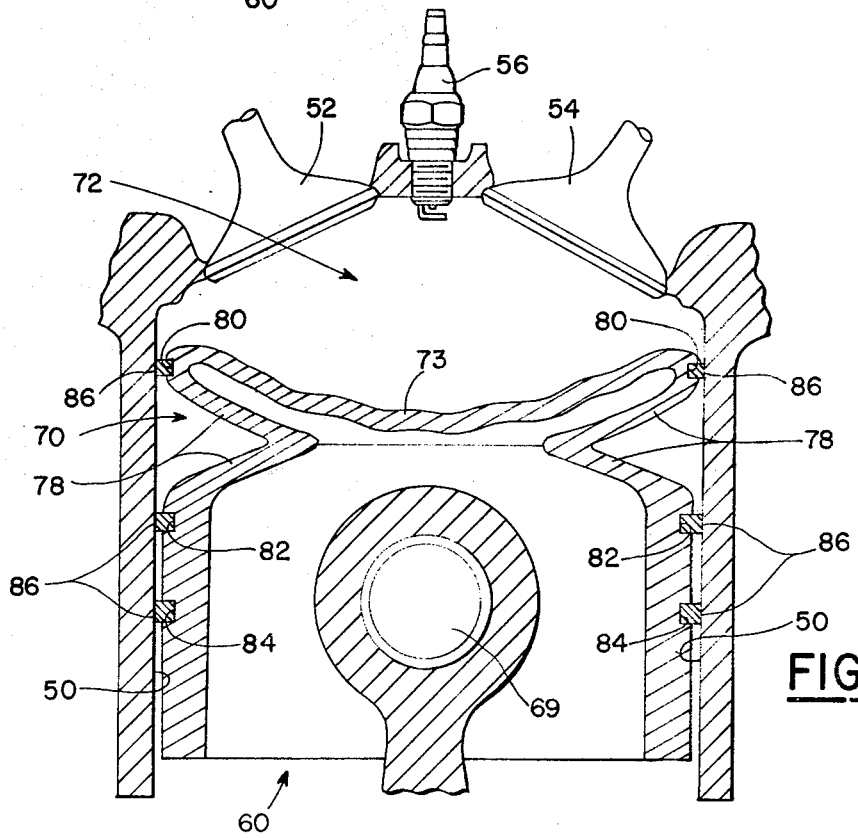
FIG. 4 is a view as in FIG. 2 of the piston of FIG. 3.

Another embodiment of the invention is shown in FIG. 3. In this embodiment cylinder 50, valves 52 and 54 and spark plug 56 are substantially the same as in the first embodiment. Piston 60 includes a base portion having cylindrical side walls 64, which are substantially the same as in the first embodiment. The base includes means for connection to a crank using wrist pin 69 in the manner described above.

Head portion 70, which faces combustion chamber 72, is joined only to the side walls 64 of base 62. The head portion includes a flexible top wall 73 adjacent the combustion chamber, as in the first embodiment. As before, top wall 73 is formed of metal which is thinner than side walls 64. The top wall is corrugated in the same manner as top wall 33 in the first embodiment. In addition, head portion 70 includes resiliently yieldable side portions between side walls 64 and top wall 73. In the embodiment of FIG. 3, such resiliently yieldable side portions include a plurality of Belleville springs 78 joined in stacked relation. The Belleville springs provide for increased downward movement of the top wall under high pressure.

As in the first embodiment, head portion 70 is preferably formed of a metal containing beryllium copper or titanium. In addition, the embodiment of FIG. 3 includes circumferential grooves 80, 82 and 84 to accommodate piston rings 86.

Operation of the embodiment of FIG. 3 is essentially the same as for the first embodiment. During throttled operation, Belleville springs 78 remain extended as shown in FIG. 3 to provide high compression operation and thus improved operating efficiency. Under open throttle conditions, high pressures within compression chamber 72 cause the Belleville springs to yield, compressing top 70 downwardly as well as causing top wall 73 to yield, thereby reducing the compression ratio of the engine.

The invention provides for improved efficiency which is known to occur in variable compression ratio engines. Extended modifications to the engine, such as the provision of additional compression chambers or the like, are not required. The pistons of the invention have none of the complex internal structure associated with prior art compressible pistons. There are no internal bolts, studs, or valves which render such prior art pistons extremely unreliable in the high heat and vibration environment of an internal combustion engine. Pistons of the present invention can be installed in many present-day engines without modification and can thus provide improved efficiency with a minimum of expense.

Alternative embodiments are possible within the scope of the invention. One such alternative would be to eliminate either the rounded shoulders or Belleville springs and make only the top wall of the head resiliently yieldable. The corrugated top portion could vary in thickness over its width to provide improved yieldability. Metals other than those containing beryllium copper or titanium could be used. It should also be noted that pistons according to the invention can be applied to either 2 or 4-cycle engines.

A piston has been provided which improves the performance of an internal combustion engine. The piston provides for a change in the compression ratio of the engine in response to pressure within the combustion chamber. This is accomplished by using a head portion of the piston which includes a flexible top wall.

What is claimed is:

1. A piston connectable to a crank for reciprocation in the cylinder of an internal combustion engine and forming one wall of a combustion chamber in the cylinder, said piston comprising: a base portion having cylindrical side walls and including means for connection with the crank, and a head portion joined only to said side walls of said base portion, said head portion including a flexible top wall adjacent the combustion chamber which is resiliently yieldable in response to pressure within the combustion chamber whereby said head portion flexes downwardly to provide for variation of the compression ratio of the engine.

2. A piston as in claim 1 in which said flexible top wall is corregated.

3. A piston as in claim 1 in which said piston is formed of metal and said head portion is formed of thinner metal than said side walls of said base portion, and said head portion includes rounded shoulder portions formed of said thinner metal joining said flexible top wall to said side wall, said rounded shoulder portions providing for increased downward movement of said flexible top wall.

4. A piston as in claim 3 in which said flexible top wall includes a plurality of substantially circular corrugations to increase the yieldability of said flexible top wall.

5. A piston as in claim 4 in which said head portion of said piston is formed of a metal containing beryllium copper.

6. A piston as in claim 4 in which said head portion of said piston is formed of a metal containing titanium.

7. A piston as in claim 1 in which said head portion further includes resiliently yieldable side portions between said side walls of said base portion and said flexible top wall thereby providing for increased downward movement of said fexible top wall.

8. A piston as in claim 7 in which said resiliently yieldable side portions include a plurality of Belleville springs joined in stacked relation.

9. A piston as in claim 7 in which said flexible top wall includes a plurality of substantially circular corrugations to increase the yieldability of said flexible top wall.

10. A piston as in claim 9 in which said flexible top wall of said head portion is formed of a metal containing beryllium copper.

11. A piston as in claim 9 in which said flexible top wall of said head portion is formed of a metal containing titanium.

* * * * *